US005740970A

United States Patent [19]

Edwards

[11] Patent Number: 5,740,970

[45] Date of Patent: Apr. 21, 1998

[54] MISTING SYSTEM

[75] Inventor: Tim L. Edwards, Wilsonville, Oreg.

[73] Assignee: Mistech, Inc., Wilsonville, Oreg.

[21] Appl. No.: 756,139

[22] Filed: Nov. 27, 1996

[51] Int. Cl.[6] ..... B05B 1/14

[52] U.S. Cl. ..... 239/551; 239/566; 239/571

[58] Field of Search ..... 239/550, 551, 239/562, 566, 567, 571, 575, 99; 99/485; 312/115

[56] References Cited

U.S. PATENT DOCUMENTS

| | | | |
|---|---|---|---|
| 1,827,175 | 10/1931 | Taylor . | |
| 2,153,356 | 4/1939 | Walker | 239/551 X |
| 2,223,762 | 12/1940 | Hall | 312/115 X |
| 4,808,303 | 2/1989 | Edwards | 312/115 |
| 4,914,339 | 4/1990 | Hayman . | |
| 4,923,258 | 5/1990 | Styles | 312/115 |
| 4,925,097 | 5/1990 | Corrigan . | |

FOREIGN PATENT DOCUMENTS

| | | | |
|---|---|---|---|
| 1513948 | 1/1968 | France | 239/551 |

*Primary Examiner*—Lesley D. Morris
*Attorney, Agent, or Firm*—Robert L. Harrington

[57] ABSTRACT

A system for applying moisture to a food product in a display case. The system has a mist bar adjustably mounted on brackets to adjust the direction of the mist. Mist tips are mounted to the mist bar at determined intervals and are individually controlled to an open or closed position. The system has a controller that controls the cycle time of the mist application. The mist tips produce a fine fog like mist that settles on the food product. The mist tips are provided with a ball check that acts as a seal and prevents dripping.

4 Claims, 3 Drawing Sheets

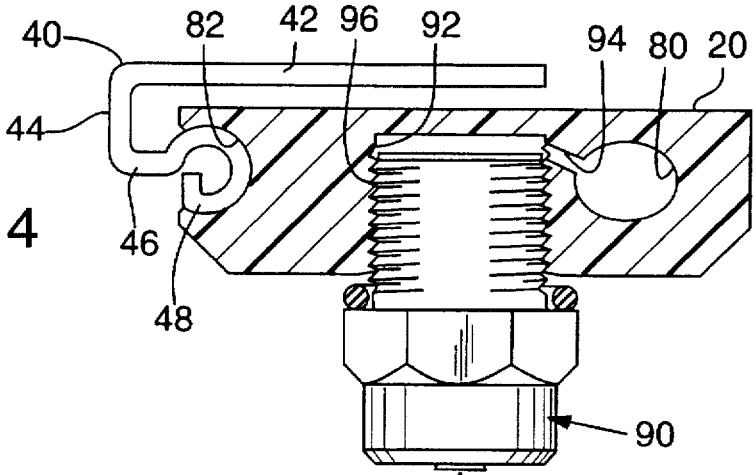
FIG. 4
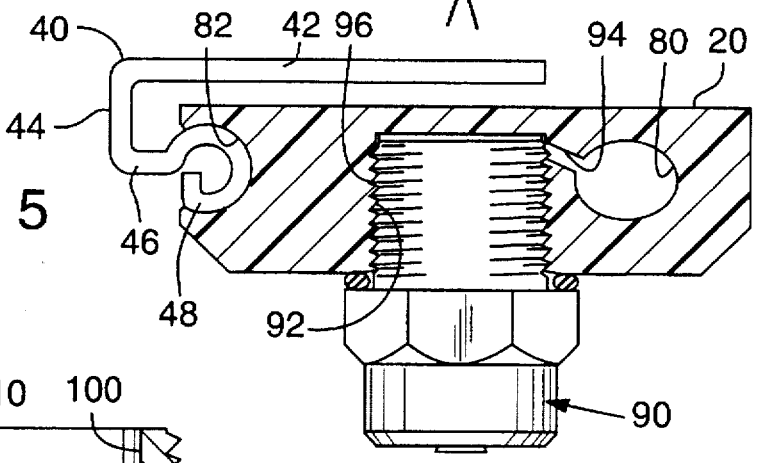
FIG. 5
FIG. 6
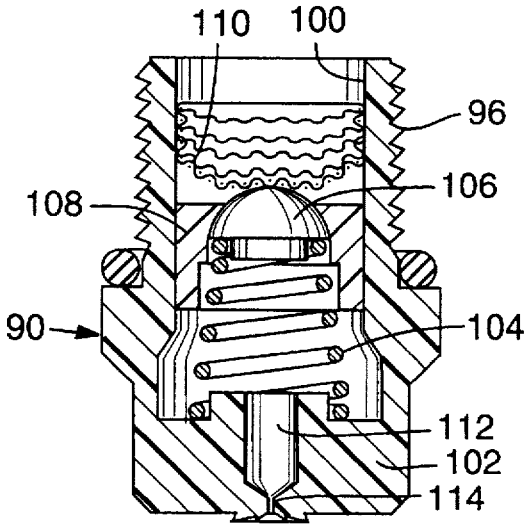
FIG. 7
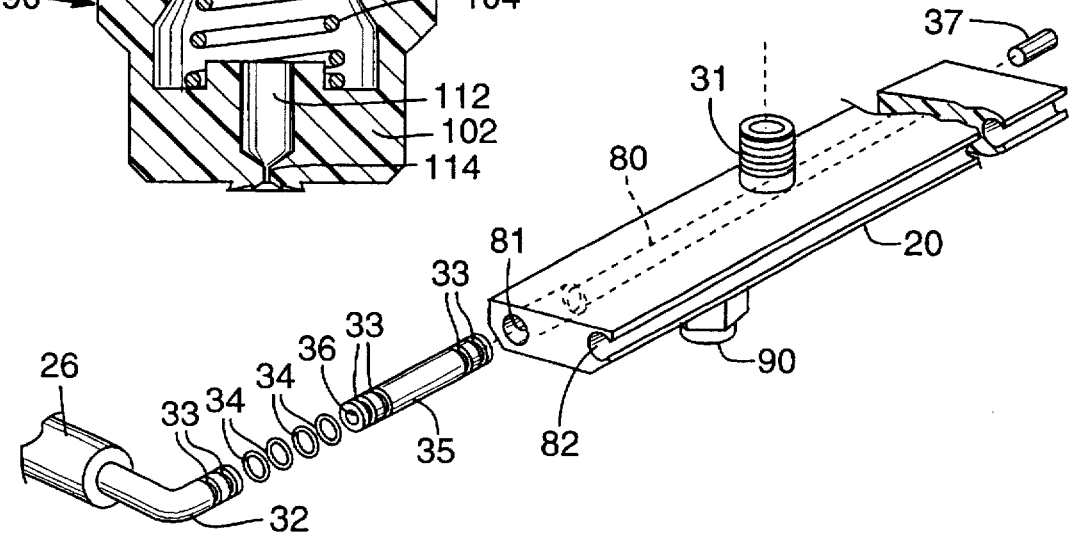

MISTING SYSTEM

FIELD OF INVENTION

This invention relates in particular to the moistening of food products displayed in grocery stores and the like and more particularly it relates to a misting apparatus used to preserve product freshness.

BACKGROUND OF THE INVENTION

Food products such as vegetables and fruits when displayed in an open display case will dry out and become unappetizing. A solution to this problem is the provision of a mister. A water line is installed over the display counter and misting nozzles are connected into the line. A timing mechanism controls a valve that turns on the water source to the line in a desired sequence and a mist is forced through the nozzles and onto the food product. The on-off cycle is typically on for 10 seconds and off for 10 minutes.

Whereas misting nozzles have been widely accepted and are considered to provide significant benefits for such food displays, they have their drawbacks. They have to be positioned to spray a desired spray pattern over a display section and this requires placement of the nozzle assemblies typically where they can be easily viewed by the customers/shoppers. The spray has to be controlled to both spray all of the vegetables displayed but avoiding spraying water on the floor. During the 10 seconds of spraying, shoppers reaching under the spray zone or into the spray zone will get wet and because there is no indication when the spray will be turned on, the customer can be startled. The spray nozzle assemblies are also adapted to adjust the direction of spray from the spray heads and can be subjected to pranks and vandalism.

BRIEF DESCRIPTION OF THE INVENTION

In the first instance the present invention eliminates the traditional nozzle fixture. A mist tip is connected directly into a misting bar (waterline). Water is forced through the mist tip to produce a mist that can be equated to fog that occurs in nature. That is the water particles are so fine that they are in suspension or near suspension in the air. The mist thus settles slowly onto the produce in the case below. The mist is typically directed from the back of the display case toward the center of the display case and initially forms a conical pattern. Because the mist is so fine, after the initial forced exit from the mist tip, the spray/cloud of moisture floats down onto the food product. A continued forced spray from the mist tip generates a rolling action (the following spray rolling over the previous spray) whereby the longer the spray continues the more spread out the cloud becomes. When initially installed the spray action is arranged by design to provide a moistening cloud that just covers the depth of the case but not beyond, i.e., onto the floor. It is determined that a typical spray cycle is a 2-second spray burst every two minutes.

The mist tip is designed to function as its own valve and can be rendered inoperative by turning the tip fully into the bar, e.g., if a particular section of the case is used to display a product that does not need moisturizing. The spray is not startling as the cloud like spray is so fine as to cause little or no discomfort to shoppers reaching into the case for a product selection. The tip is a fraction of the size of prior nozzle assemblies and can be blended into the display case typically in the rear of the case rather than in the front whereat the prior nozzle assemblies were mounted.

The mounting position and angle of spray are important in customizing the spray action to the particular display case. The water line is provided in a bar like member that is adjustably mounted to a bracket. Thus the installer of the system first determines where the bar should be located, installs the brackets, mounts the bar to the brackets, and then physically, angularly adjusts the bar relative to the bracket to achieve the desired direction of spray from the mist tips installed into the bar.

These and other advantages of the invention will be more fully appreciated upon reference to the following detailed description of the invention having reference to the accompanying drawings.

BRIEF DESCRIPTION OF THE DRAWINGS

FIGS. 4 and 5 are sectional views of the mist bar illustrating the mounting arrangements of mist tips;

FIG. 6 is a sectional view of a mist tip;

FIG. 7 is another view of a mist bar of the mist system of FIG. 1; and

DESCRIPTION OF THE PREFERRED EMBODIMENT

Figure 1:
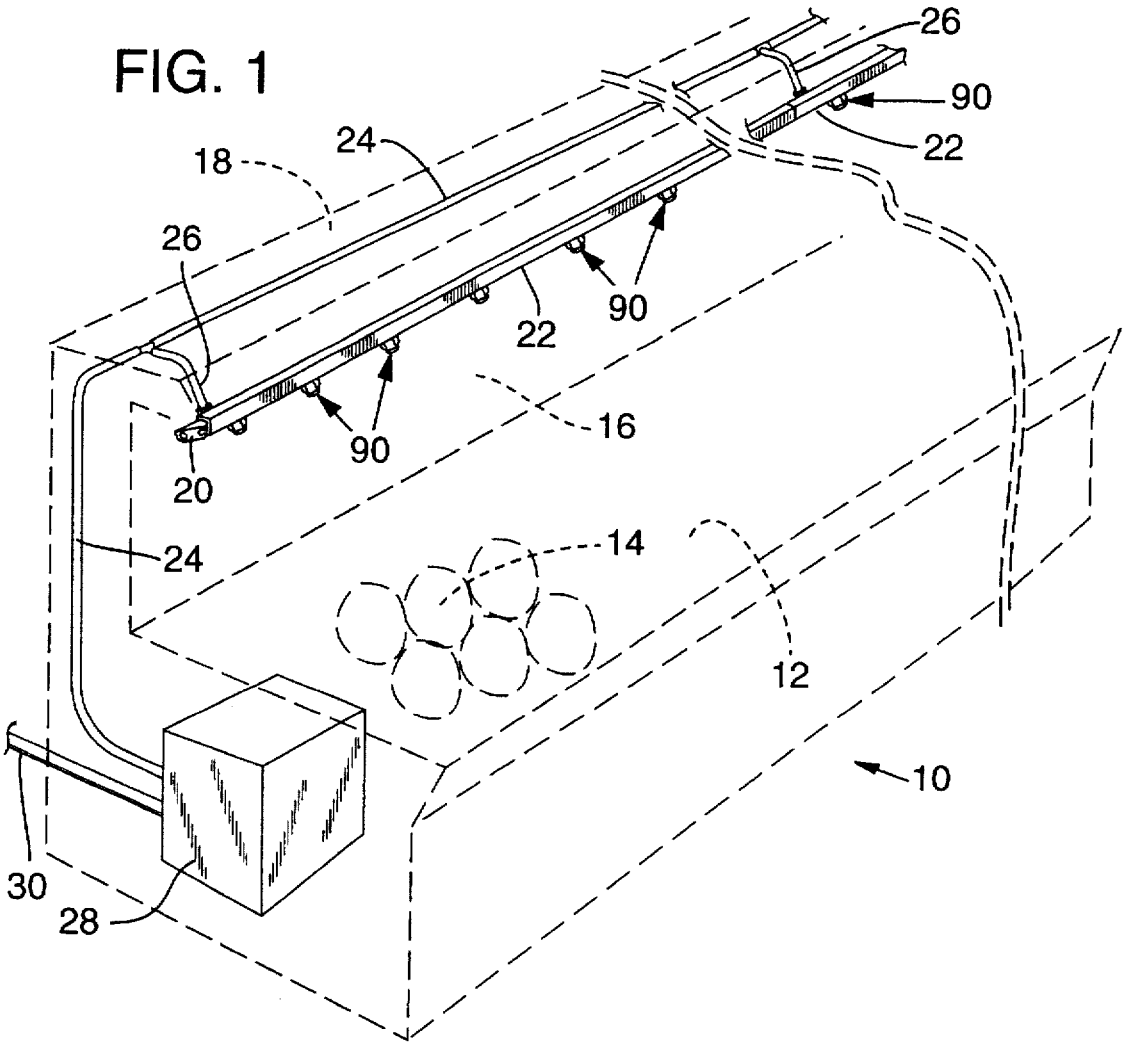
FIG. 1 is a view of a display case that incorporates a misting system of the present invention.

Refer now to FIG. 1 of the drawings that illustrates a display case 10 that is typically utilized in markets to display produce such as fruits and vegetables. The case 10 may be of other configurations than that illustrated but generally is of the type that has a shelf 12 for placement of produce 14. The shelf 12 is at a convenient height for a shopper and has a depth that is of a dimension that makes it convenient for a shopper to select any items of produce 14 displayed on the shelf 12. The display case 10 has a rear wall 16 that extends upwardly from the shelf 12 and supports a top 18. The top 18 is most often arranged with light fixtures (not illustrated) for illuminating the produce 14 placed on the shelf 12. The top 18 in this embodiment also supports the mist system of the present invention. The mist system of the present invention has a mist bar 20 that is adjustably mounted on brackets generally designated as 22.

Each mist bar 20 is connected to a water line 24 by flexible connecting lines 26. The water line 24 is in turn coupled to a water controller 28. The controller 28 is connected to the in-house water source by a water line 30 in a conventional manner.

FIG. 7 illustrates two examples of connections for connecting the mist bar 20 to the flexible water line(s) 26. A coupling 31 in a first example is mounted in a bore of the mist bar 20 that communicates with the bore 80. The flexible water line 26 is connected to the coupling 31 to provide a water supply to the mist bar 20. In the second example, the bore 80 at the end of the mist bar 20 has an enlarged bore 81. A connector 32 is sized to fit in the bore 81. The connector 32 has o-ring grooves 33 fitted with o-rings 34 to provide a seal. The flexible water line 26 is connected to the connector 32 in a conventional manner to provide a water supply to the mist bar 20. There are other known connectors available that may be used in place of the coupling 31 and the connector 32. The bore 81 may, for example, be threaded to receive a threaded connector and the coupling 31 may be replaced by an elbow.

A coupling 35 (having a through bore 36) is also illustrated in FIG. 7 for coupling one mist bar 20 to another. The coupling 35 has o-ring grooves 33 fitted with o-rings 34 to provide a seal. The coupling 35 is installed in the enlarged bores 81 of two adjoining mist bars 20 to couple the two mist bars together. When the enlarged bore 81 is not used to couple two mist bars 20 together or is not used as a connection to the water source, the enlarged bore 81 is fitted with a plug 37.

The mist system of the present invention is arranged to supply a fine fog like mist onto the produce 14 received on the shelves 12 at timed intervals. Typically the controller 28 will apply water through the mist bar 20 for a time of about two seconds at ten minute intervals. The controller 28 is, however, arranged so that the cycle time of the mist being applied and the time interval between each application may be adjusted.

Figure 2:
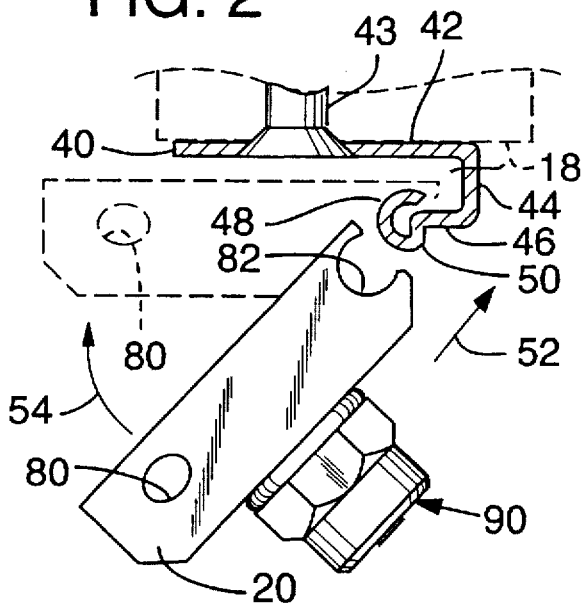
FIGS. 2 and 3 are end views of mounting brackets for mounting a mist bar to the display case of FIG. 1.
Figure 3:
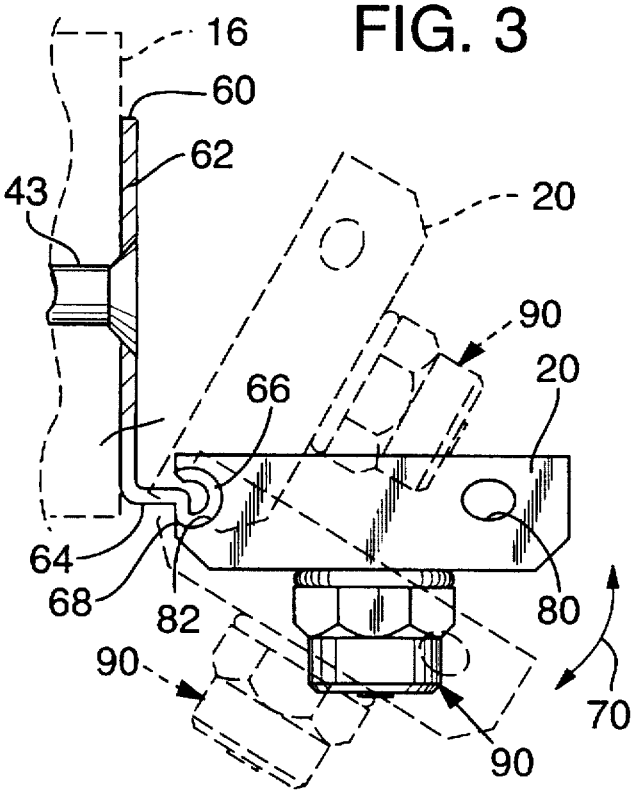

Two variations of brackets 22 that support the mist bar 20 are illustrated in FIGS. 2 and 3; a bracket 40 in FIG. 2 is suited for mounting to the top 18 and a bracket 60 in FIG. 3 suited for mounting to the wall 16. The brackets 22 are configured to suit the mounting arrangement of the mist bar 20 on the display case 10. In the embodiment of FIG. 1, the brackets 22 (40) are fixedly attached to the top 18 and are arranged for the adjustable mounting of the mist bar 20.

Refer now to the end view of FIG. 2 that illustrates one type of bracket 22 (designated as 40). The bracket 40 is just one of the types of brackets 22 utilized to adjustably support the mist bar 20. The bracket 40 has a mounting leg 42 that is affixed to the case 10 by known fasteners 43 in a conventional manner. Extending from an end of the leg 42 is a short leg 44. Extending from the leg 44 substantially parallel to the leg 42 is a support leg 46. A spherical like member 48 extends from the leg 46 and is arranged to be inserted into an arcuate section 82 of the mist bar 20. The spherical member 48 has a relieved section 50 that permits the member 48 to be inserted into the arcuate section 82 as indicated by arrow 52. The mist bar 20 is pivotally adjusted relative to the bracket 40 as indicated by arrow 54. The spherical like member 48 is resilient so that it will expand to its original shape even if it is somewhat compressed during mounting of the mist bar 20 to the bracket 40. The member 48 in contact with the arcuate member 82 of the mist bar 20 provides sufficient friction to maintain the mist bar in an adjusted position.

FIG. 3 illustrates another mounting bracket 60 that has an elongate leg 62. Extending from one end of the leg 62 is a short leg 64 on which a spherical like member 66 extends. The spherical member 66 has a relieved section 68 that permits the member 66 to be inserted into the arcuate section 82 of the mist bar 20. The spherical member 66 is arranged to be inserted into the arcuate section 82 of the mist bar 20 in the same manner as bracket 40. FIG. 3 shows a mist bar 20 mounted on the bracket 60 and is pivotally adjustable to the limits indicated by the dashed outline of the mist bar 20 and arrow 70.

The mist bar 20 is illustrated in FIGS. 1–5. The mist bar 20 is an elongate member that is generally rectangular in section and as illustrated in FIG. 1 extends along the width of the display case 10. The mist bar 20 is supported on the case 10 by a selected bracket 22. The mist bar 20 has a bore 80 (conduit) extending along its length. The bore 80 is for delivering water to the mist tips 90 that are mounted to the mist bar 20. The mist bar 20 has an arcuate section 82 formed in one edge that extends along the length of the bar. The arcuate section 82 is matable with the spherical members 48 and 66 of the mounting brackets 40 and 60.

The mounting arrangement of the mist tips 90 is best seen in FIGS. 4 and 5. The mist tips are mounted at spaced intervals along the length of the mist bar 20. In the embodiment of FIG. 1, the mist tips 90 are mounted at about every 9 inches along the length of the mist bar 20. A tapped bore 92 is provided in the mist bar 20. The tapped bore 92 is connected to the bore 80 by a cross bore 94. Each mist tip 90 has a threaded section 96 that is threadably installable in the bore 92 of the mist bar 20. The tapped bore 92 may be positioned such that it intersects the bore 80 in the mist bar 20, thus eliminating the cross bore 94.

FIG. 4 illustrates a mist tip 90 installed in the threaded bore 92 of the mist bar 20. The mist tip 90 is positioned in the bore 92 such that water will flow from the bore 80 through the cross bore 94 into the threaded bore 92 and through the mist tip 90. This is referred to as the open position. The water flowing through the mist tip 90 will generate a very fine fog like mist to moisten the produce 14 in the case 10.

FIG. 5 illustrates the mist tip 90 installed in the bore 92 and positioned to close off the cross bore 94 to prevent water from entering the bore 92 thus preventing water flowing through the mist tip 90. This is referred to as the closed position.

The sectional view of FIG. 6 further illustrates the mist tip 90. The mist tip has an internal bore 100 that extends from the top of the threaded portion 96 to a base 102. Supported on the base 102 is an assembly of a spring 104 and valve poppet (ball check) 106. A valve seat 108 is mounted in the bore 100 and is positioned strategic to the assembly of the spring 104 and valve poppet 106. The spring 104 biases the valve poppet 106 against the valve seat 108. A fine mesh screen 110 is mounted above the valve seat 108. A bore 112 extends through the base 102 and has a small diameter exit bore 114 (orifice) for generating a fine fog like mist when water flows through the mist tip 90.

The mist tip 90 is normally closed, that is the spring 104 biases the valve poppet 106 against the valve seat 108. When water pressure is applied and the mist tip 90 is in the mounted position as shown in FIG. 4, water will flow through the bore 80 into the bore 100 of the mist tip 90. The pressure of the water applied against the valve poppet 106 will cause the valve poppet 106 to move away from the valve seat 108 permitting water to flow out the exit bore 114. When the applied water pressure is released, the spring 104 will force the valve poppet 106 to seat in the valve seat 108 to seal the interior of the mist tip 90 and to prevent any dripping from the mist tip 90.

Figure 8:
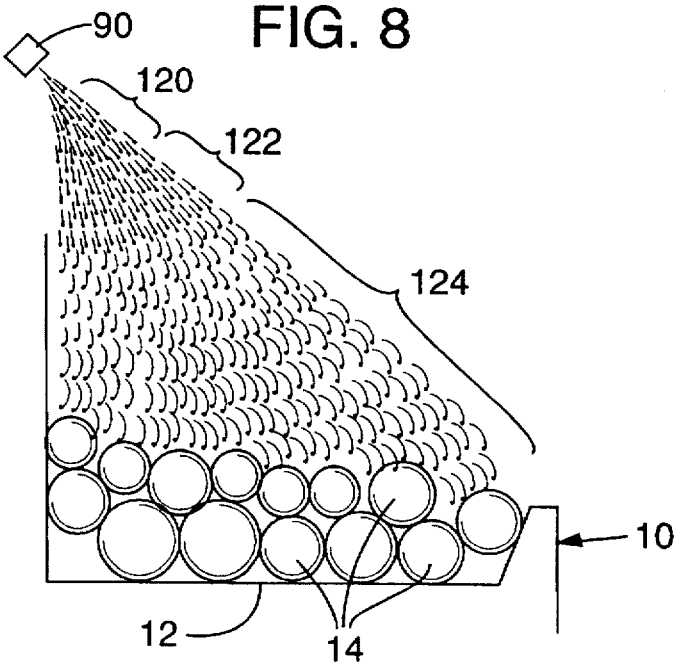
FIG. 8 is a schematic illustration of the misting action achieved by the misting system of the present invention.

FIG. 8 is provided to illustrate the spraying action achieved by applicant's system. The initial discharge of the fine fog like mist 120 from the mist tip 90 is under pressure and generates a fast moving spray pattern that is somewhat conical. This spray pattern persists for a distance of about 8–10 inches and the spray then goes through a transition indicated at 122 where it converts to a floating fog or cloud of moisture 124. Continued discharge of the fine fog like mist develops a rolling action where downward moving spray crowds the floating cloud and essentially rolls over the top of the cloud while also converting to cloud like form. This very fine mist slowly settles onto the produce 14 placed on the shelf 12 of the case 10. The fineness of the mist is a benefit in that a shopper may extend a hand or arm into the mist without experiencing a noticeable wetting of the arm or hand. The pattern is controllable and the produce is moistened evenly and more often to generate a more even condition of moisturization throughout the display period.

Those skilled in the art will recognize that modifications and variations may be made without departing from the true spirit and scope of the invention. The brackets are illustrated as being the same length as the mist bar 20. It will be appreciated that the brackets may be of shorter length or that multiple short brackets may be provided to support the mist bar 20. Also the spherical like member on each of the brackets may be a solid member rather than a spherical hook like member illustrated.

The invention is therefore not to be limited to the embodiments described and illustrated but is to be determined from the appended claims.

I claim:

1. A misting assembly for controlled moisturization of a designated area comprising;

a water line;

mounting members mounting the water line in a spaced overhead position relative to a designated area to be moisturized;

a water source providing a water supply under a determined water pressure to said water line;

a water source control for controlling the on/off flow of water to the water line; and mist tips installed directly into said water line at spaced intervals along said water line, said mist tips having an orifice that determines the direction of spray from said water line onto the designated area; and said mounting of the water line containing said mist tips, said water pressure, and said water source control and said mist tips all cooperatively designed and arranged to produce a fine cloud like mist directed to a targeted portion of said designated area over an interval of time causing a spreading action of the spray as the spray settles onto the designated area to be turned off precisely as the designated area is covered by said cloud like mist.

2. A misting assembly as defined in claim 1 wherein an elongate bar is provided with a conduit extended through its length providing thereby said water line, said bar having threaded openings at spaced intervals along the bar length intercepting the conduit, said mist tips having threaded exteriors mated to said threaded openings for interconnecting the mist tips with said conduit and the water provided thereby.

3. A misting assembly as defined in claim 2 wherein said openings intersect the conduit at one side of the conduit to avoid blockage of water flow through the conduit with a mist tip screwed fully into the opening to thereby block the flow of water from the conduit to the opening.

4. A misting assembly as defined in claim 3 wherein said mounting members and said bar have mated portions that provide a hinge interlock enabling the bar to be mounted to the members and pivoted to a desired angular position.

* * * * *